US011570873B2

(12) United States Patent
Sinur et al.

(10) Patent No.: US 11,570,873 B2
(45) Date of Patent: Jan. 31, 2023

(54) MULTI-MODAL LIGHTING CONTROL

(71) Applicant: Broan-NuTone LLC, Hartford, WI (US)

(72) Inventors: Richard R. Sinur, Hartford, WI (US); Kyle Anderson, Hartford, WI (US)

(73) Assignee: Broan-NuTone LLC, Hartford, WI (US)

( * ) Notice: Subject to any disclaimer, the term of this patent is extended or adjusted under 35 U.S.C. 154(b) by 0 days.

(21) Appl. No.: 17/583,842

(22) Filed: Jan. 25, 2022

(65) Prior Publication Data

US 2022/0264729 A1 Aug. 18, 2022

Related U.S. Application Data

(60) Provisional application No. 63/148,729, filed on Feb. 12, 2021.

(51) Int. Cl.
*H05B 47/10* (2020.01)
*H05B 47/17* (2020.01)

(52) U.S. Cl.
CPC ..... *H05B 47/17* (2020.01)

(58) Field of Classification Search
CPC ..... H05B 47/10; H05B 47/14; H05B 47/115; H05B 47/16; H05B 47/17; A61N 5/067; A61N 5/0624
See application file for complete search history.

(56) References Cited

U.S. PATENT DOCUMENTS

| | | | | |
|---|---|---|---|---|
| 10,492,684 | B2 * | 12/2019 | Khachaturian | A61B 5/02416 |
| 11,253,721 | B2 * | 2/2022 | Bae | H01L 33/504 |
| 2017/0135180 | A1 * | 5/2017 | Broers | H05B 47/175 |
| 2021/0402212 | A1 * | 12/2021 | Schupp | A61N 5/067 |

* cited by examiner

*Primary Examiner* — Thai Pham
(74) *Attorney, Agent, or Firm* — Barnes & Thornburg LLP

(57) ABSTRACT

A control system and method for implementing control of a multi-modal lighting system. The system includes a lighting device and a mode control method/system. The mode control method/system initiates a first mode including generation of white light as a default. Then, after the multi-modal lighting system is activated, a second mode 114 is may be initiated and the multi-modal lighting system 102 remains activated.

20 Claims, 3 Drawing Sheets

MULTI-MODAL LIGHTING CONTROL

PRIORITY CLAIM

This application claims priority under 35 U.S.C. § 119(e) to U.S. Provisional Application Ser. No. 63/148,729, filed Feb. 12, 2021, which is incorporated by reference herein.

TECHNICAL FIELD

The present subject matter relates to control systems for lighting systems, and more particularly, to control of a multi-modal lighting system.

BACKGROUND

Often times, users, e.g., homeowners, decorators, designers, contractors, include lighting elements in rooms. It may be desirable for lighting elements to provide certain disinfecting functions in addition to conventional illumination, such as bathroom lighting elements. Combination of these functionalities may realize efficiencies, such as shared electrical connections and shared cut-outs into adjacent structure (e.g. a wall or a ceiling). Further, a grille covering a lighting element provides both aesthetic and functional value. Therefore, a system and method for implementing control of a multi-modal lighting system such that general lighting and antimicrobial lighting may be achieved through one system represents an improvement in the art.

The description provided in the background section should not be assumed to be prior art merely because it is mentioned in or associated with the background section. The background section may include information that describes one or more aspects of the subject technology.

SUMMARY

In accordance with on aspect of the present disclosure, a method of controlling a multi-modal lighting system includes detecting at least one switching sequence; entering a first operating mode or a second operating mode in response to detection of the at least one switching sequence; and switching from the first operating mode to the second operating mode in response to a counter reaching a temporal threshold, wherein the second operating mode generates antimicrobial light.

In some embodiments, the second mode generates violet antimicrobial light. In some embodiments, the first operating mode generates a light to illuminate a room of a building. In some embodiments, the first operating mode is entered prior to the second operating mode.

In some embodiments, the at least one switching sequence includes a first switching sequence that causes the multi-modal lighting system to change from an initial off state to the first operating mode and a second switching sequence that, when entered prior to the temporal threshold, causes the multi-modal lighting system to change from the first operating mode to the second operating mode. In some embodiments, the multi-modal lighting system includes a switch and the first switching sequence includes moving the switch from an opened position to a closed position, and the second switching sequence includes moving the switch from the closed position, to the opened position, and back to the closed position. In some embodiments, the second switching sequence is completed within a predetermined amount of time.

In some embodiments, the at least one switching sequence includes a first switching sequence that causes the multi-modal lighting system to change from an initial off state to the first operational mode and a second switching sequence that causes the multi-modal lighting system to change from the initial off state to the second operating mode. In some embodiments, the multi-modal lighting system includes a switch and the first switching sequence includes moving the switch from an opened position to a closed position, and the second switching sequence includes moving the switch from the opened position to closed position, back to the open position, and back to the closed position.

In some embodiments, the temporal threshold is adjustable by a user input into the multi-modal lighting system.

In accordance with another aspect of the present disclosure, a method of controlling a multi-modal lighting system includes: detecting a first switching sequence; entering a first operating mode in response to detection of the first switching sequence, wherein a lighting device generates an illumination light in the first operating mode to illuminate a room in a building; and entering a second operating mode in response to detection of a second switching sequence different than the first switching sequence, wherein the lighting device generates antimicrobial light in the second operating mode. In some embodiments, the second mode generates violet antimicrobial light.

In some embodiments, the first switching sequence causes the multi-modal lighting system to change from an initial off state to the first operating mode and the second switching sequence causes the multi-modal lighting system to change from the first operating mode to the second operating mode. In some embodiments, the multi-modal lighting system includes a switch and the first switching sequence includes moving the switch from an opened position to a closed position, and the second switching sequence includes moving the switch from the closed position, to the opened position, and back to the closed position. In some embodiments, the second switching sequence is completed within a predetermined amount of time.

In some embodiments, the first switching sequence causes the multi-modal lighting system to change from an initial off state to the first operating mode and the second switching sequence causes the multi-modal lighting system to change from the initial off state to the second operating mode. In some embodiments, the multi-modal lighting system includes a switch and the first switching sequence includes moving the switch from an opened position to a closed position, and the second switching sequence includes moving the switch from the opened position to closed position, back to the open position, and back to the closed position.

In accordance with another aspect of the present disclosure, a multi-modal lighting system includes a lighting device including a light fixture housing, a first light source coupled to the light fixture housing and configured to generate illumination light, and a second light source coupled to the light fixture housing and configured to generate anti-microbial light. The system may further include an input device configured to receive an input to change the lighting device from an initial off state to a first operating state in which the first light source generates the illumination light while the second light source generates no light. The system may further include a control system coupled to the lighting device and configured to change the lighting device from the first operating state to a second operating state in response to a timer reaching a temporal threshold, wherein in the second operating mode the second light source generates the anti-microbial light.

In some embodiments, the control system is configured to change the lighting device from the initial off state to the first operating mode in response to a first switching sequence received by the input device, the control system is configured to change the lighting device from the first operating mode to the second operating mode in response to a second switching sequence received by the input device, and the control system is configured to change the lighting device from the initial off state to the second operating mode in response to a third switching sequence received by the input device.

In some embodiments, the input device includes a switch and the first switching sequence includes moving the switch from an opened position to a closed position, the second switching sequence includes moving the switch from the closed position, to the opened position, and back to the closed position, and the third switching sequence includes moving the switch from the opened position to closed position, back to the open position, and back to the closed position.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

Figure 1:
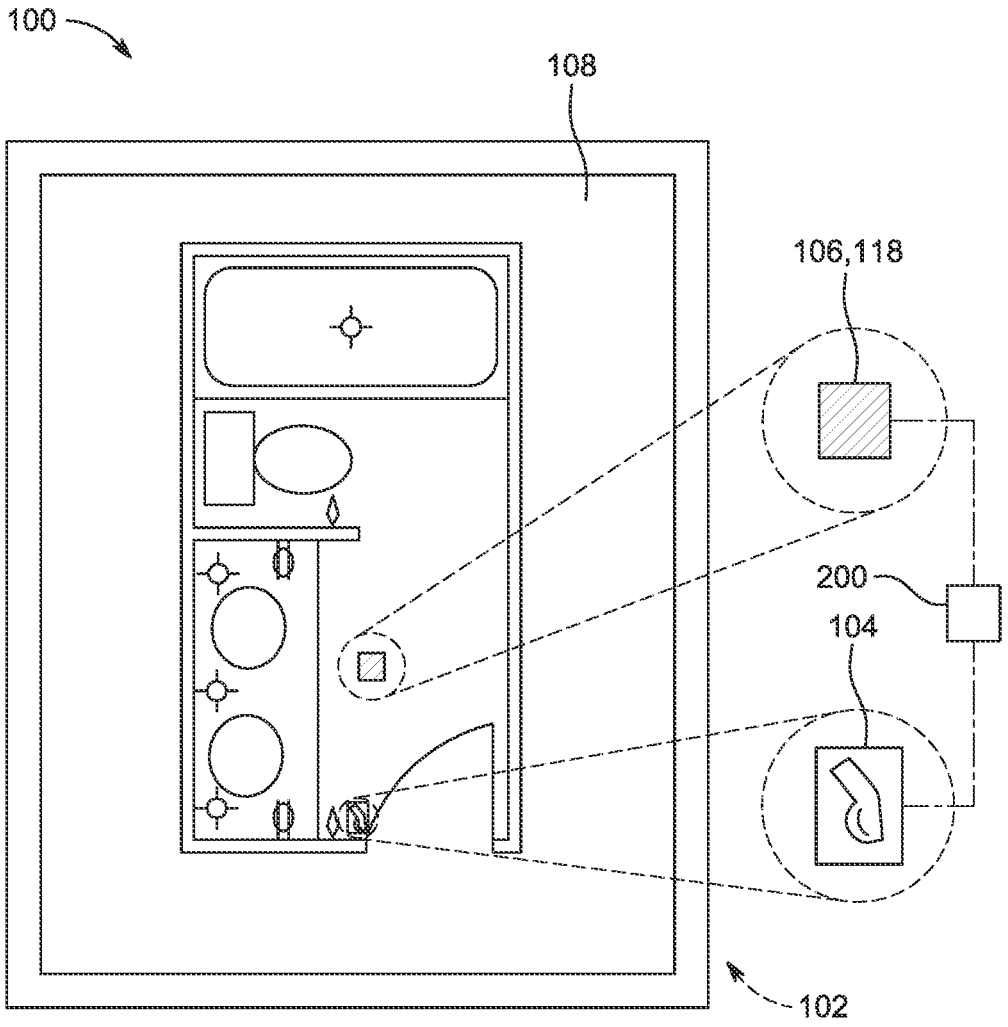
FIG. 1 depicts an exemplary bathroom layout illustrating a proximal location where a multi-modal lighting system may be disposed and operated in accordance with embodiments.
Figure 2:
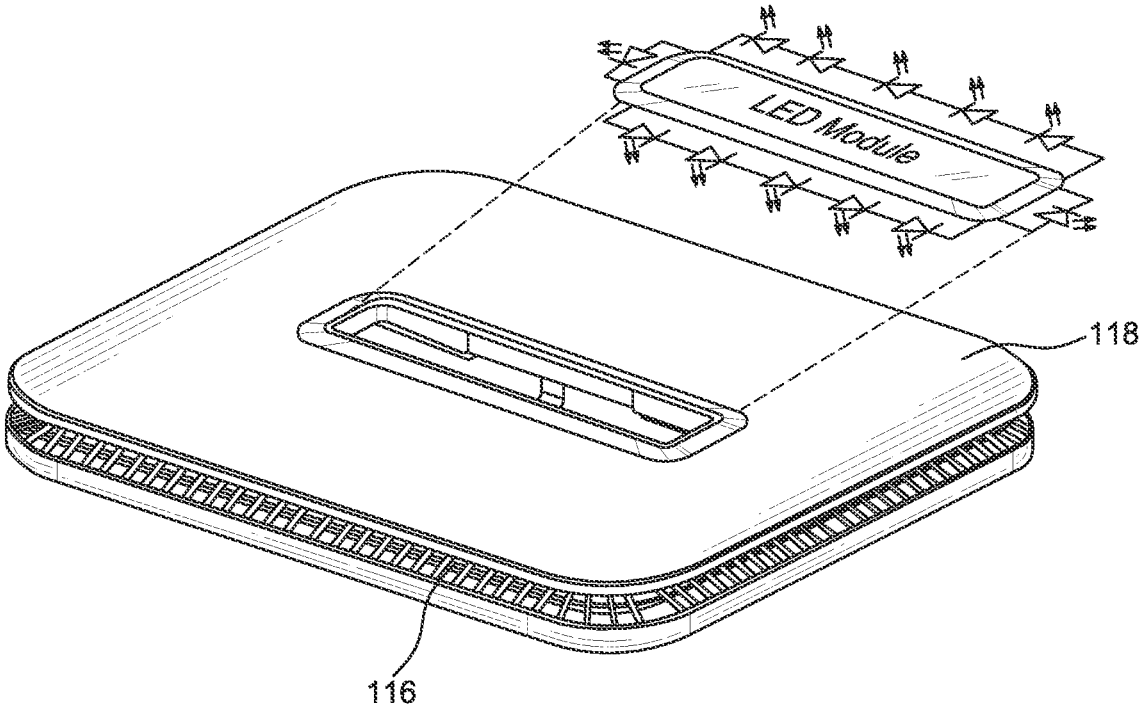
FIG. 2 illustrates an exemplary multi-modal lighting system operable by a control system and method compatible therewith.
Figure 3:
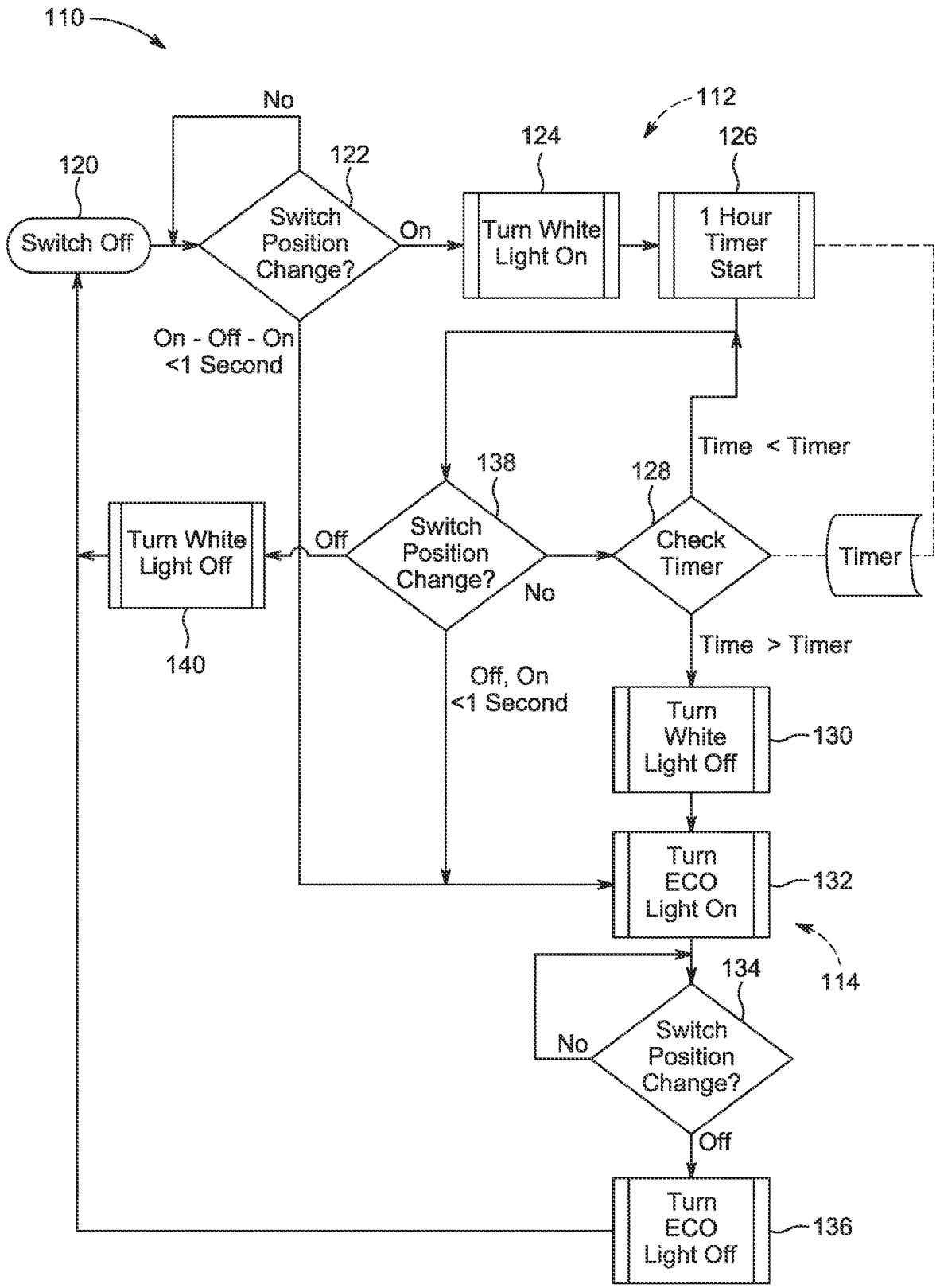
FIG. 3 is a flowchart illustrating operation of a control system and method implementing control of the multi-modal lighting system of FIG. 2.

Generally, the present disclosure details, with reference to FIGS. 1-3, a control system and method 100 for implementing control of a multi-modal lighting system 102. The present disclosure contemplates arrangement of a lighting device 106 within a bathroom layout 108 comprising a variety of components, as shown in FIG. 1. The bathroom layout 108 may comprise more or fewer components relative the exemplary bath layout 108. Often times, the lighting device 106 may be centrally located within the bathroom layout. Alternatively, the lighting device 106 may comprise one or more lighting devices and control therefor as described hereinthroughout. The control system and method 100 may be applied to each of the lighting devices, all of the lighting devices, and/or a subset of the lighting devices.

The system and method 100 for implementing control of the multi-modal lighting system 102 comprises a mode control method 110 (see FIG. 3). The mode control method/system 110 initiates a first mode 112 comprising generation of white light as a default. Then, after the multi-modal lighting system 102 is activated, a second, "ECO" mode 114 is automatically initiated after a timer reaches one hour (or another pre-selected temporal threshold) and the multi-modal lighting system 102 remains activated. Further, at any time while the multi-modal lighting system 102 is operational, a user may manually initiate the ECO mode by using a pre-selected on/off switching sequence. In exemplary embodiments, the multi-modal lighting system 102 includes a switch 104, such as a SPST120V 60 Hz wall switch or another suitable switch, for controlling power to the multi-modal lighting system 102 and inputting switching sequences (see FIG. 3) to the multi-modal lighting system 102.

The white light mode 112 can comprise creation of any standard white light. The ECO mode 114 in exemplary embodiments is a light that kills microbes ("antimicrobial"). In the bathroom setting, the multi-modal lighting system 102 permits a user to leave the lighting device 106 on and, after one hour (or another pre-determined or selectable time period) has elapsed, the multi-modal lighting system 102 automatically switches to the ECO mode 114, thereby providing an antimicrobial and/or disinfecting function to kill bacteria, viruses, microorganisms, etc. to the bathroom layout 108 in locations reached by the light from the ECO mode 114. Further, at the discretion of a user (e.g. upon vacating the space) the multi-modal lighting system 102 may be toggled between the first mode 112 and the ECO mode 114 in response to manual operation of the switch 104 according to a pre-selected sequence. The multi-modal lighting system 102 may be toggled between the ECO mode 114 and the first mode 112, or between the "off" state and either of the first mode 112 and the ECO mode 114.

The lighting device 106 comprises a light source housed within an LED light fixture 118. In exemplary embodiments, the light source may include LEDs configured to emit light with antimicrobial properties such as described in U.S. Pat. No. 10,357,582 for "Disinfecting Lighting Device", the entire disclosure thereof being hereby incorporated by reference herein. Embodiments may emit antimicrobial light that is violet rather than ultraviolet. Other suitable LEDs and LED devices capable of emitting antimicrobial LED light are also contemplated. In further examples, the light source may include a first subset of LEDs that emit antimicrobial light and a second subset of LEDs that emit white light and/or light having other properties suitable for general illumination.

The multi-modal lighting system 102 may be configured as a replacement for conventional lighting fixtures, whether LED, incandescent, or fluorescent. In order to facilitate the dual purposes of antimicrobial lighting/disinfection and general illumination, one or more lens modules may be configured about the light source of the LED lighting fixture 118. Lens material may be particularly designed and/or selected to maintain a lighting intensity, warmth, and color desirable for general illumination while simultaneously allowing for emission, and direction or dispersion, of antimicrobial light.

In an exemplary embodiment, differing lens modules may be associated with the second subset of LEDs that are customized to either general illumination and the first subset of LEDs for antimicrobial illumination.

A housing of the light fixture 118 may be selected based on aesthetics, water-proof qualities, and/or to suitably illuminate a particular space. In one embodiment, such as the embodiment depicted in FIG. 3, the light fixture housing 118 is configured as a grille for an exhaust fan grille defining an opening 116 permitting the intake of exhaust air to be directed out of the bath layout 108. In this embodiment, the functionality of the exhaust fan, white light and antimicrobial light are provide in a single product. An LED driver is associated with the multi-modal lighting system 102 to operate the light source of the LED light fixture 118. The driver may include dimming capabilities and operatively connect the light source to the system and method 100 for implementing control of the multi-modal lighting system 102. One or more switches or control panels (e.g., touch screen control panels) may further be operably connected to the LED driver as part of the multi-modal lighting system 102. In alternative embodiments, the first mode and/or the ECO mode may include dimmer settings suitable to achieve desired goals (e.g., the ECO mode may return the light source to full, undimmed power to facilitate disinfection).

In exemplary embodiments of the LED light fixture 118, LEDs are evenly distributed over the entire surface of the LED light fixture 118 to prevent the occurrence of unlit areas and diminish the observability of individual LEDs when viewed through the lens modules. Additionally, the LED light fixture 118 and grille thereof are arranged such that the individual LEDs and PC board are not visible through the lens modules.

Referring now to FIG. 3, a flowchart illustrates operation of the control system and method 100 implementing control of the multi-modal lighting system 102 in accordance with the mode control method 110. The mode control method 110 begins with a switch supplying power to the multi-modal lighting system 102 in an off (i.e., open) position at state 120. At decision step 122, a change in position of the switch is detected. If the switch does not change position, the detection step 122 is iterated. If the switch is actuated to the on (i.e., closed) position, the multi-modal light system 102 enters the first mode 112 and white light is emitted, such as for general illumination at step 124. Once the multi-modal light system 102 has entered the first mode 112, the timer begins a one-hour (or other time) counter at step 126. The state of the timer is checked at step 128, and if the elapsed time has not yet surpassed one hour, then the timer check step 128 is iterated. If the elapsed time has surpassed one hour (or other time), then the first mode 112 is discontinued at step 130 and emission of white light is ended.

At step 132, the multi-modal light system 102 enters the ECO mode 114 and emission of antimicrobial light is initiated. The ECO mode 114 persists for as long as the switch remains in the on position. At step 134, the multi-modal light system 102 detects whether the switch remains in the on position or has been actuated to the off position by a user. When the switch is actuated to the off position, the ECO mode 114 is discontinued at step 136 and the mode control method 110 returns to the initial off state 120.

At decision step 122, a change in position of the switch is detected, as noted above. If the switching sequence (i.e., on-off-on) is detected at step 122, then the multi-modal light system 102 enters the ECO mode 114 at step 132 and proceeds therefrom in accordance with the above description. In this example, the multi-modal light system 102 may enter the ECO mode 114 only when the switching sequence is completed within a predetermined amount of time, i.e. within 3 seconds.

If, during the one-hour (or other time) counter step 126, a change in the switch position is detected at step 138, then the counter step 126 is ended, the first mode 112 is discontinued, and emission of white light is ended at step 140. After the white light emission is ended at step 140, the multi-modal light system 102 returns to the initial off state 120. Instead, if during the one-hour (or other time) counter step 126, the switch position step 138 detects a switching sequence (i.e., off-on), then the multi-modal light system 102 jumps ahead to step 132 thereby discontinuing the first mode 112 and entering the ECO mode 114. At step 132 the mode control method 110 proceeds in accordance with the above description. In this example, the multi-modal light system 102 may enter the ECO mode 114 only when the switching sequence is completed within a predetermined amount of time, i.e. within 3 seconds.

The one-hour counter step 126 may be adjusted by user input into the system 100 so that the system 100 changes from the first mode 112 to the second mode 114 at another, user desired time threshold (i.e. one-half hour, 2 hours, 3 hours, etc.). In one example, the system 100 includes a mechanical switch (on lighting device 106, for example) that may be manipulated by a user to set the desired time threshold. In another example, a user input is made to the control system to program the system 100 with the desired time threshold.

The embodiment(s) described above may be combined in full or in part, with any alternative embodiment(s) described.

Exemplary System Architecture

Architecturally, the representative technology may be deployed at residential locations or for commercial floorplans. Embodiments of the disclosed system and method 100 are described with reference to FIGS. 1-3. In certain aspects, the system and/or method 100 may be implemented using hardware or a combination of software and hardware, either by dedicated devices and control networks or integrated into other control systems such as a control microchip or centralized building lighting control. Computing device(s) and networks implementing the system and/or method 100 may be, for example, desktop computers, mobile computers, voice-controlled or voice activate devices, mobile devices (e.g., a smartphone or personal digital assistant), or any other devices having appropriate processor (e.g. processor 200), memory, and communications capabilities for implementing the control method 110 of FIG. 3 and storing and detecting the plurality of switching sequences.

Effectiveness of the antimicrobial light is increased with increased exposure of the surrounding area to the antimicrobial light. Therefore, maximizing time spent in the ECO mode 114 increases the antimicrobial and disinfecting effects of the system 100. Therefore, a system that enters the ECO mode at the direction of a user (e.g., through one of the switching sequences) or at the expiration of a timer may increase the disinfecting operational time. Increases in operational time in the ECO mode 114 increase the amount of antimicrobial/disinfecting effect achieved. Still further, a user is able to return to the first mode 112 whenever white light for general illumination is desired (e.g., regardless of whether the multi-modal lighting system 102 is currently in an off state or operating in the ECO mode 114).

According to one aspect of the present disclosure, the disclosed system can be implemented using a computer system in response to a processor (e.g. processor 200)

executing one or more sequences of one or more instructions contained in memory. Such instructions may be read into memory from another machine-readable medium, such as data storage device. Execution of the sequences of instructions contained in main memory causes the processor to perform the process steps described herein. In alternative implementations, hard-wired circuitry may be used in place of or in combination with software instructions to implement various implementations of the present disclosure. Thus, implementations of the present disclosure are not limited to any specific combination of hardware circuitry and software. The timer and switching sequence may be stored in a memory associated with a microcontroller housed within the lighting fixture 118 or else in operable communication with the multi-modal lighting system 102.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Numerous modifications to the present disclosure will be apparent to those skilled in the art in view of the foregoing description. Preferred embodiments of this disclosure are described herein, including the best mode presently known carrying out the disclosure. It should be understood that the illustrated embodiments are exemplary only, and should not be taken as limiting the scope of the disclosure.

What is claimed is:

1. A method of controlling a multi-modal lighting system, comprising:

using a processor executing one or more sequences of instructions to detect at least one switching sequence;

using the processor to enter a first operating mode or a second operating mode in response to detection of the at least one switching sequence; and using the processor to switch from the first operating mode to the second operating mode in response to a counter reaching a temporal threshold, wherein the second operating mode generates antimicrobial light.

2. The method of claim 1, wherein the second mode generates violet antimicrobial light.

3. The method of claim 1, wherein the first operating mode generates a light to illuminate a room of a building.

4. The method of claim 3, wherein the first operating mode is entered prior to the second operating mode.

5. The method of claim 3, wherein the at least one switching sequence includes a first switching sequence that causes the multi-modal lighting system to change from an initial off state to the first operating mode and a second switching sequence that, when entered prior to the temporal threshold, causes the multi-modal lighting system to change from the first operating mode to the second operating mode.

6. The method of claim 5, wherein the multi-modal lighting system includes a switch and the first switching sequence includes moving the switch from an opened position to a closed position, and the second switching sequence includes moving the switch from the closed position, to the opened position, and back to the closed position.

7. The method of claim 6, wherein the second switching sequence is completed within a predetermined amount of time.

8. The method of claim 3, wherein the at least one switching sequence includes a first switching sequence that causes the multi-modal lighting system to change from an initial off state to the first operating mode and a second switching sequence that causes the multi-modal lighting system to change from the initial off state to the second operating mode.

9. The method of claim 8, wherein the multi-modal lighting system includes a switch and the first switching sequence includes moving the switch from an opened position to a closed position, and the second switching sequence includes moving the switch from the opened position to closed position, back to the open position, and back to the closed position.

10. The method of claim 1, wherein the temporal threshold is adjustable by a user input into the multi-modal lighting system.

11. A method of controlling a multi-modal lighting system, comprising:

using a processor executing one or more sequences of instructions to detect a first switching sequence;

using the processor to enter a first operating mode in response to detection of the first switching sequence, wherein a lighting device generates an illumination light in the first operating mode to illuminate a room in a building; and using the processor to enter a second operating mode in response to detection of a second switching sequence different than the first switching sequence, wherein the lighting device generates antimicrobial light in the second operating mode.

12. The method of claim 11, wherein the second mode generates violet antimicrobial light.

13. The method of claim 11, wherein the first switching sequence causes the multi-modal lighting system to change from an initial off state to the first operating mode and the second switching sequence causes the multi-modal lighting system to change from the first operating mode to the second operating mode.

14. The method of claim 13, wherein the multi-modal lighting system includes a switch and the first switching sequence includes moving the switch from an opened position to a closed position, and the second switching sequence includes moving the switch from the closed position, to the opened position, and back to the closed position.

15. The method of claim 14, wherein the second switching sequence is completed within a predetermined amount of time.

16. The method of claim 11, wherein the first switching sequence causes the multi-modal lighting system to change from an initial off state to the first operating mode and the second switching sequence causes the multi-modal lighting system to change from the initial off state to the second operating mode.

17. The method of claim 16, wherein the multi-modal lighting system includes a switch and the first switching sequence includes moving the switch from an opened position to a closed position, and the second switching sequence includes moving the switch from the opened position to closed position, back to the open position, and back to the closed position.

18. A multi-modal lighting system comprising a lighting device including a light fixture housing, a first light source coupled to the light fixture housing and configured to generate illumination light, and a second light source coupled to the light fixture housing and configured to generate anti-microbial light, an input device configured to receive an input to change the lighting device from an initial off state to a first operating state in which the first light source generates the illumination light while the second light source generates no light, and a control system including a processor for executing one or more sequences of instructions, the control system coupled to the lighting device and configured to change the lighting device from the first operating state to a second operating state in response to a timer reaching a temporal threshold, wherein in the second operating mode the second light source generates the antimicrobial light.

19. The system of claim 18, wherein the control system is configured to change the lighting device from the initial off state to the first operating mode in response to a first switching sequence received by the input device, the control system is configured to change the lighting device from the first operating mode to the second operating mode in response to a second switching sequence received by the input device, and the control system is configured to change the lighting device from the initial off state to the second operating mode in response to a third switching sequence received by the input device.

20. The system of claim 19, wherein the input device includes a switch and the first switching sequence includes moving the switch from an opened position to a closed position, the second switching sequence includes moving the switch from the closed position, to the opened position, and back to the closed position, and the third switching sequence includes moving the switch from the opened position to closed position, back to the open position, and back to the closed position.

* * * * *